US007323632B2

(12) United States Patent
Wachter

(10) Patent No.: US 7,323,632 B2
(45) Date of Patent: Jan. 29, 2008

(54) PERCUSSION TRANSDUCER

(76) Inventor: Martin Richard Wachter, 2107 Sulgrave Ave., Baltimore, MD (US) 21209

( * ) Notice: Subject to any disclaimer, the term of this patent is extended or adjusted under 35 U.S.C. 154(b) by 117 days.

(21) Appl. No.: 10/920,590

(22) Filed: Aug. 18, 2004

(65) Prior Publication Data

US 2005/0039593 A1 Feb. 24, 2005

Related U.S. Application Data

(60) Provisional application No. 60/496,150, filed on Aug. 19, 2003.

(51) Int. Cl.
*G10H 3/14* (2006.01)

(52) U.S. Cl. ..... 84/730; 310/329; 310/331

(58) Field of Classification Search ..... 84/730–732; 310/329, 331, 339, 33
See application file for complete search history.

(56) References Cited

U.S. PATENT DOCUMENTS 3,588,310 A * 6/1971 Gschwandtner ..... 84/687
4,030,396 A * 6/1977 Mariner ..... 84/731
4,314,495 A * 2/1982 Baggs ..... 84/731
4,319,514 A 3/1982 Donohoe
4,876,675 A * 10/1989 Ogura et al. ..... 367/155
4,927,299 A * 5/1990 Ramalingam et al. ..... 407/120
4,984,498 A 1/1991 Fishman
5,748,566 A * 5/1998 Goodson ..... 367/158
6,576,829 B1 * 6/2003 Hart ..... 84/737
2002/0014810 A1 * 2/2002 Maruyama ..... 310/323.06
2006/0066181 A1 * 3/2006 Bromfield et al. ..... 310/363

FOREIGN PATENT DOCUMENTS

GB 2173031 A * 10/1986

* cited by examiner

*Primary Examiner*—Lincoln Donovan
*Assistant Examiner*—David S. Warren
(74) *Attorney, Agent, or Firm*—Max Stul Oppenheimer

(57) ABSTRACT

A ring-shaped percussion transducer for converting a striking impact into a representative electrical pulse triggering signal is suitable for mounting on the center axis of a percussion instrument. In a preferred embodiment, the transducer is formed of a piezo electric material of ring shape; protected on the top and bottom by thinner ring shaped washers; enclosed in a protective coating and mounted along the center axis of a percussion device which when struck transmits vibrations to the percussion transducer. The percussion transducer is connected to conventional downstream electronics so as to produce a sound responsive to the striking impact.

8 Claims, 5 Drawing Sheets

PERCUSSION TRANSDUCER

This application is entitled to, and claims the benefit of, priority from U.S. Provisional Application Ser. No. 60/496,150, filed Aug. 19, 2003.

FIELD AND BACKGROUND OF THE INVENTION

1. Field of the Invention

The present invention relates in general to electronic percussion instruments, and more particularly to a novel transducer for use therein.

2. Background Information

Electronic percussion instruments are a class of musical instruments which are designed to be played like traditional acoustic percussion instruments but offer an unlimited spectrum of sounds, ranging from the emulation of real acoustic instruments to heavily synthesized abstract sounds and noises. Electronic percussion instruments are comprised of a striking surface that the user strikes with their hand, foot or other implement such as a stick or mallet, a means to sense the strike and transfer it from acoustic energy into an electrical pulse (a transducer), and downstream electronics (a sound module) which is responsible for analyzing the electronic pulse and playing a sound which is representative of the characteristics of the strike (for example, amplitude, velocity, position, timing and others).

The striking surface could be made from almost any material and most electronic percussion manufacturers try to simulate the look and feel of acoustic instruments to allow the user to use traditional and existing playing skills. This is analogous to how electronic synthesizer keyboards try to emulate the look, feel, and playability of an acoustic piano. Both the synthesizer keyboard and traditional acoustic piano have the same key layout and can be played using similar skills, but are designed to produce musical sounds differently. The ultimate design for a musician trained as a piano player is to have the look, feel, and playability of a traditional acoustic piano with the versatility, expandability, and conveniences of the electronic synthesized keyboard instrument. Likewise, it would be an advantage for a traditionally trained percussionist who desires to utilize the advantages of electronic percussion instruments, to be able to retain the familiar look, feel, and playability of traditional acoustic percussion instruments.

The current state of the art in electronic percussion triggers utilizes inexpensive flat disc shaped piezo transducers which are mounted somewhere on the striking surface or connected components. There are several disadvantages to this approach.

Problems associated with current percussion transducers include:

- The use of a flat disc shaped transducer prohibits central mounting on the same axis as the striking surface.
- Flat transducers attached directly to the striking surface at locations other than the center cause the striking surface to become unbalanced.
- Unbalanced striking surfaces require additional mechanisms to prevent the striking surface from unintentionally rotating and tipping over.
- It is difficult to use conventional cymbals for striking surfaces as the piezo transducers can't be reliably attached to the striking surface and the conventional cymbal's motion and playability are compromised.
- Poor positional sensing because the piezo transducer is not centrally located.

- As the striking surface swings after impact, the electrical connection to the piezo transducer, its connections, or the striking surface may be broken due to the changing distances caused by the swinging motion.

Note that, while the ideal mounting location is referred to as the "center", the term is not used in a precise geometric sense, but rather refers to a location sufficiently close to the geometric "center" or center axis to accomplish the purposes of the invention. The term "center axis" refers to an axis perpendicular to the striking surface of an instrument (whether represented by a physical structure or only a point) and roughly equidistant from symmetric points on the edge of said striking surface.

SUMMARY OF THE INVENTION

The foregoing problems are overcome, and other advantages are provided by a device for transferring mechanical vibrations of percussion instruments into electrical trigger pulses utilizing a ring shaped percussion transducer centrally mounted in relation to the striking surface.

When a user strikes the striking surface of a percussion instrument, the percussion transducer converts the impact into a representative electrical signal which may be transmitted to conventional downstream electronics so as to produce a sound responsive to the impact. The combination of a piezo transducer coupled to a striking surface is sometimes referred to as a "percussion trigger". When a piezo transducer is used in conjunction with a percussion instrument, it is sometimes referred to as a "percussion transducer".

In accordance with another feature of the invention, a relatively thin protective covering layer of a resilient material may be provided over the outer surfaces of a piezo electric percussion transducer assembly so as to dampen high-frequency resonances, function as a reinforcement and provide protection from normal wear and tear.

Among the advantages of the invention over previous percussion transducers are:

- Utilizing a ring shaped transducer instead of a flat disc element allows mounting on a central axis or spindle.
- Central mounting allows the striking surface to remain balanced.
- It can be utilized with a greater range of shapes of striking surface including conventional metal cymbals.
- Central mounting allows an even radial response and positional sensing from the center of the striking surface.
- Central mounting does not require attachment to the striking surface, and therefore allows the user to remove or interchanging the striking surface without disconnecting the electronics. For example, in the case of a cymbal, the ring shaped transducer may be mounted on the cymbal stand and attached to the electronics, and coupled to the striking surface by releasably bolting the striking surface to the ring shaped transducer.
- It can be mounted on existing cymbal holders and stands.
- Central mounting does not interfere with the striking surface.
- Central mounting allows the striking surface to exhibit natural playing characteristics such as free rotation, proper swing, and natural stick response.

The objects of my invention are:

- To provide a percussion trigger that converts acoustic hits into electrical trigger pulses.

To provide a percussion trigger that is centrally mounted in relation to the striking surface.

To provide a percussion trigger that allows proportional triggering response radially in all directions relative to the center of the striking surface.

To provide a percussion trigger that is not limited in the choice of shape of the striking surface.

To provide a percussion trigger that can be retrofitted onto existing mounting hardware.

To provide a percussion trigger that does not have to be attached to the striking surface.

To provide a percussion trigger that allows the striking surface to remain balanced.

The various features of novelty which characterize the invention are pointed out with particularity in the claims annexed to and forming a part of this disclosure. For a better understanding of the invention, its advantages and objects, reference is made to the accompanying drawings and descriptive matter in which a preferred embodiment of the invention is illustrated.

BRIEF DESCRIPTION OF THE DRAWINGS

The foregoing and still other objects of this invention will become apparent, along with various advantages and features of novelty residing in the present embodiments, from study of the following drawings, in which.

DESCRIPTION OF THE PREFERRED EMBODIMENT

Figure 1:
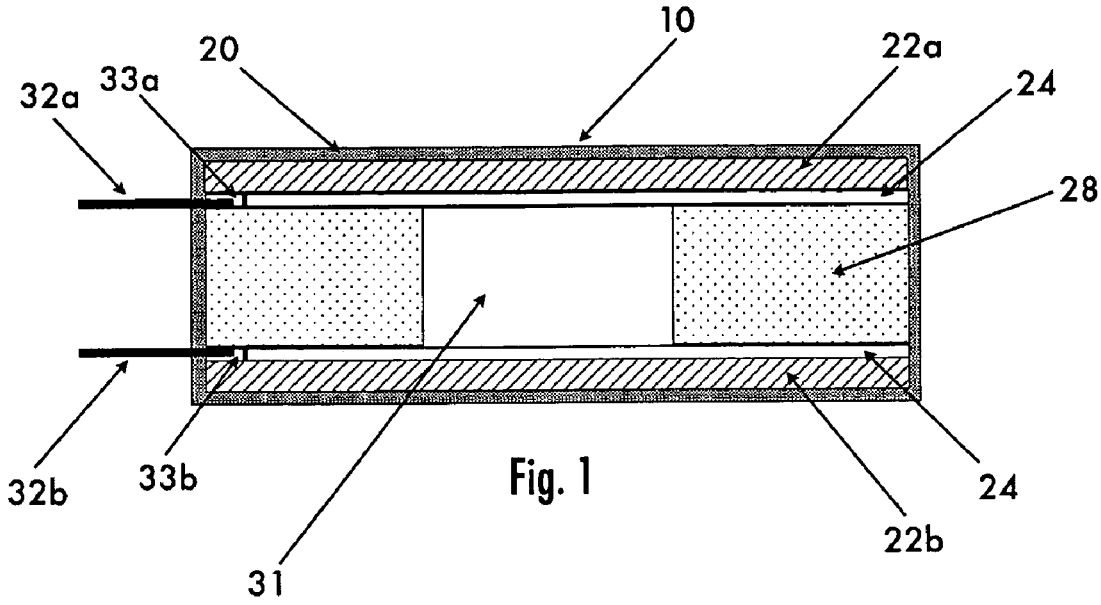
FIG. 1 is a cross section view from the side of the percussion transducer.

Referring to the drawings, the invention is a novel device for transferring mechanical vibrations of percussion instruments (i.e., instruments having a striking surface) into electrical trigger pulses utilizing a ring shaped percussion transducer suitable for being centrally mounted in relation to the striking surface of the percussion instrument. The ring shaped percussion transducer is illustrated in FIG. 1.

Using a ring shaped piezo ceramic transducer, instead of a flat piezo disc such as described in U.S. Pat. No. 4,984,498, allows the transducer to be centrally mounted in relation to the striking surface of the percussion instrument and share the radial center. The ring transducer is mounted on the same axis as the striking surface. Although the ring transducer could be mounted anywhere along the spindle mount, it is most effective when acoustically coupled to the striking surface. This provides maximum sensitivity while reducing sympathetic vibrations from other closely mounted devices.

The percussion transducer generates electronic pulses which are converted into corresponding values using an external electronic interface which then generates sound.

While applicable to any percussion instrument, the construction and operation of the invention may be illustrated with respect to a cymbal.

As shown in FIG. 1, the percussion transducer (10) comprises a round piezo ceramic element (28) with a hole (31) in its center of approximately half the diameter of the piezo ceramic element (28), with a top lead wire (32*a*) attached to the top of the piezo ceramic element and a bottom lead wire (32*b*) attached to the bottom of the piezo ceramic element. The piezo ceramic element (28) may comprise a piezo electric ring having oppositely-disposed planar electrodes on either side thereof. A suitable piezo electric material is comprised of lead zirconate titanate (PZT). These electrodes may be silver electrodes. Means are provided for fixedly sandwiching the piezo electric ceramic ring between upper and lower shim or tab washers. This means for fixedly sandwiching may comprise an electrically conductive adhesive such as a conductive epoxy or double sided adhesive tape. The washer means should provide sufficient rigidity to protect the ceramic surface of the piezo ceramic element and may, for example, be comprised of a thin metal or a rigid plastic material.

Means are provided for fastening the piezo electric transducer to the instrument. For example, in one embodiment the top and bottom sides of the piezo ceramic element (28) may be covered with thin adhesive layers (24). Bonded to the adhesive layers (24) are protective washers (22*a* and 22*b*). The outside and inside diameters of the washers (22*a* and 22*b*) are similar to that of the piezo ceramic element (28). A small notch (33) is cut into the outside edge of each washer (22*a* and 22*b*). A protective coating (20), preferably a relatively thin covering layer is preferably provided over the outer surfaces of the piezo electric transducer assembly. This layer provides a protective coating around the components to protect the assembly. Although many materials could be used to provide this protective coating, a liquid rubber coating, for example PERFORMIX PLASTI-DIP (TM), available from PlastiDip International, is suitable. This is a room temperature multipurpose rubber coating that exhibits excellent moisture, acid, alkaline, and abrasion resistance that essentially does not "harden", but instead stays in a relatively resilient state that is resilient and soft to the touch. This resilient layer dampens high-frequency resonances, functions as a reinforcement for the solder joint on the top and bottom of the piezo electric ceramic ring and provides protection from normal wear and tear.

The two lead wires (32*a* and 32*b*) may be combined into a single cable (32) and connected to an electronic interface (76, shown on FIG. 7) for generating sounds in response to striking the instrument.

Figure 2:
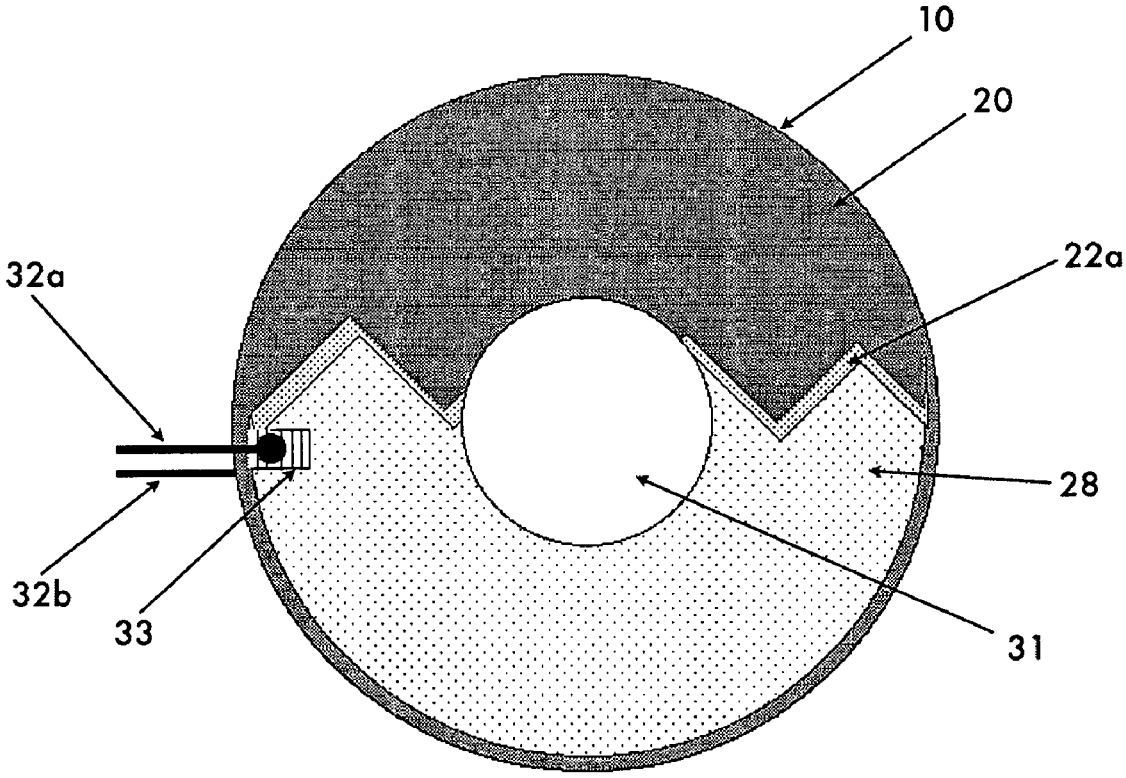
FIG. 2 is a top view of the percussion transducer.

FIG. 2 shows a top view of the invention with the protective coating (20) and the top washer (22*a*) pealed back to show the underlying piezo ceramic element (28) with a central hole (31), making it easier to see the small notch (33) which is cut from the top washer (22*a*) to allow the top washer (22*a*) to be bonded evenly and perpendicular to the piezo ceramic element (28), while allowing room for the top lead wire (32*a*) to be attached to the top of the piezo element (28).

The bottom washer (22*b*) is identical to the top washer (22*a*) and also allows the bottom lead wire (32*b*) to be attached to the bottom of the piezo element (28).

FIGS. 3-7 illustrate the preparation, installation and use of the invention in connection with a cymbal.

Figure 3:
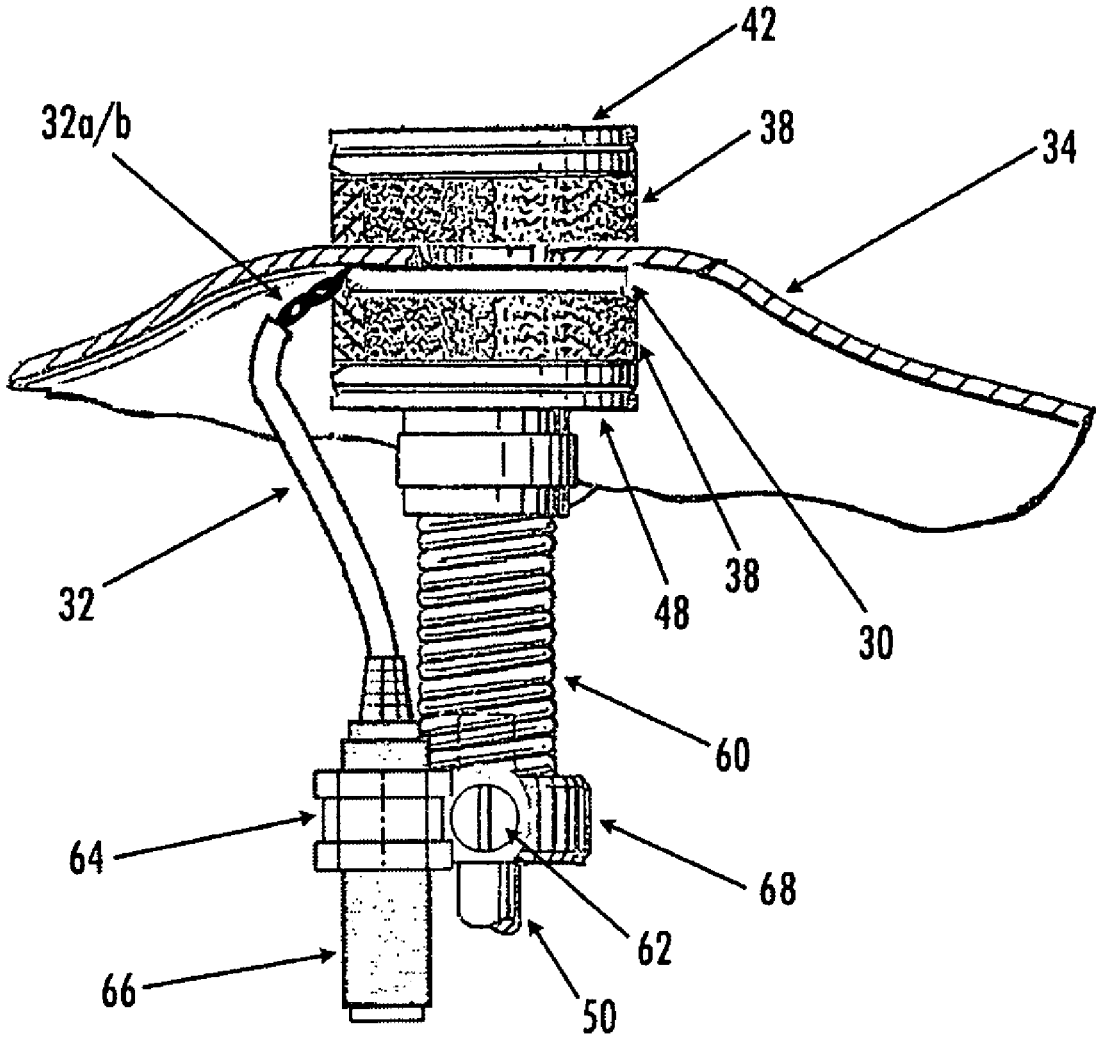
FIG. 3 a side view of an embodiment of the percussion transducer mounted centrally on an existing cymbal holder, showing a cross section of the cymbal striking surface.

As shown in FIG. 3, the two lead wires (32*a* and 32*b*) may be combined into a single cable (32) which transfers the electrical pulse (generated by the striking surface 34 transferring energy to the percussion transducer 30) to an external electronic interface (76, shown on FIG. 7) suitable for converting the signal to a usable form acceptable for generating a sound. A standard audio jack (66) connected to the other end of the cable (32) allows the user flexibility for connecting the percussion transducer (30) to the electronic interface (xx). The audio jack (66) may be mounted to the instrument (illustrated in FIG. 3 as a cymbal holder (68)) using a clamp (64) attached via a mounting screw (62).

The cymbal mounting device shown in FIG. 3 (similar to the cymbal mounting device in U.S. Pat. No. 4,319,514) is mounted on a central spindle (50) and utilizes a spring mechanism (60) attached to a T shaped mounting sleeve (48). On top of the mounting sleeve (48) is a cushioning ring (38), then the percussion transducer (30). The cymbal's striking surface (34) has a center bored hole which is aligned with the percussion transducer (30), then topped with another cushioning ring (38) and a screw on nut (42) which holds the centrally mounted components together on the spindle. In this manner, the components are centrally mounted on the same axis, the spindle (50).

Figure 4:
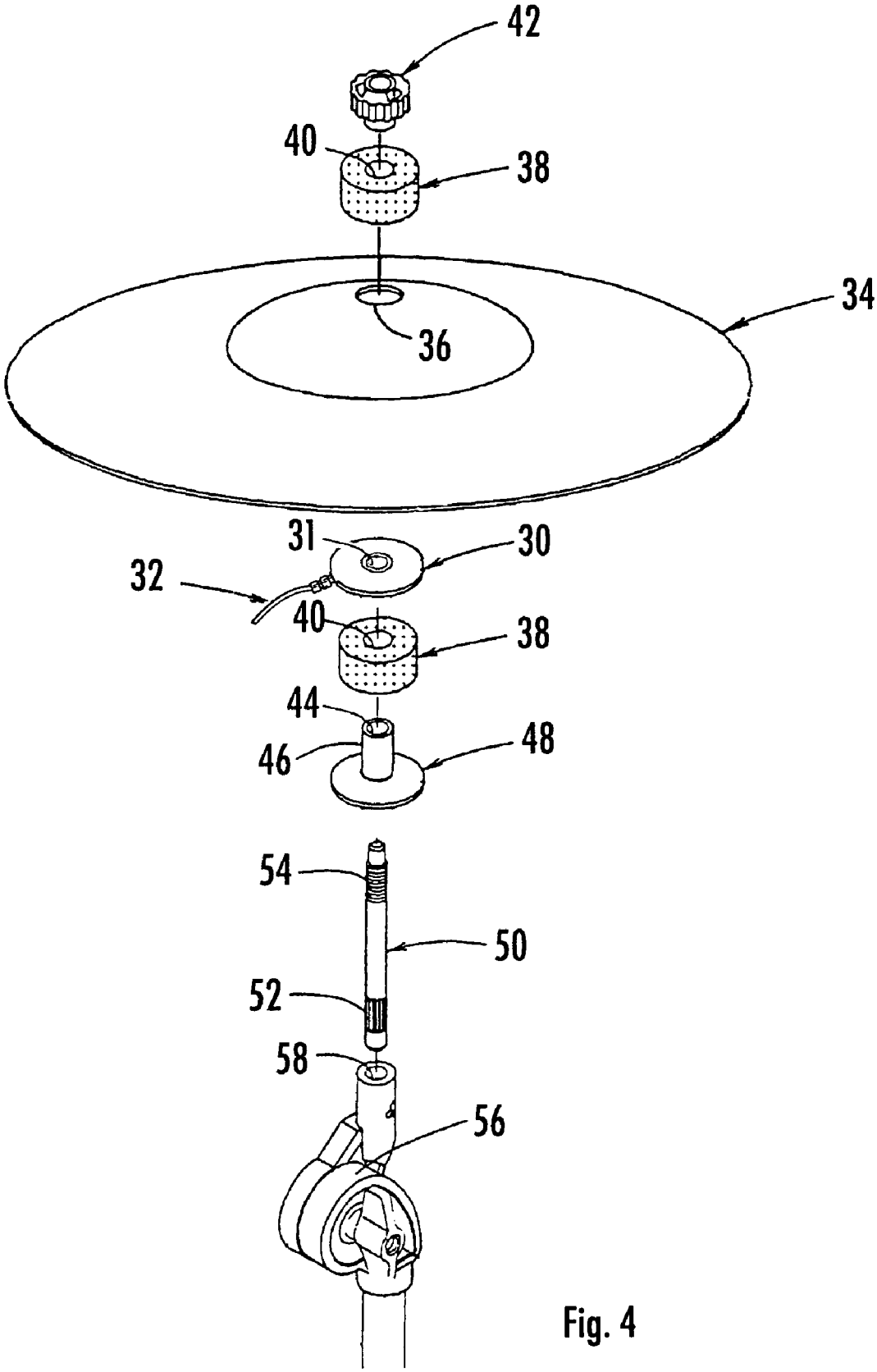
FIG. 4 is an exploded view of the percussion trigger mounted centrally on a different existing cymbal holder.

FIG. 4 shows an exploded view of the percussion transducer used on a typical cymbal mounting device. The cymbal mounting device shown includes a tilting mechanism (56) and a threaded spindle (50) attached to the tilting mechanism by threads (52). The top portion of the spindle is also threaded to allow the screw on bolt (42) to secure the components onto the spindle.

As shown in FIG. 4, the following components are all center mounted onto the spindle (50). The T shaped mounting sleeve (48) has a mounting hole (44) inside of cylindrical sleeve (46). The cushioning ring (38) has a center hole (40) which slips over the cylinder sleeve (46). The percussion transducer (30) with its center hole (31) and cable (32) is placed on top of the cushioning ring (38) and the cylindrical sleeve (46). The striking surface (34) with a center bored hole (36) is then placed on top of the spindle (50), directly in contact with the percussion transducer (30). The top cushioning ring (38) is placed on top of the striking surface and the screw on bolt (42) holds everything in place.

Figure 5:
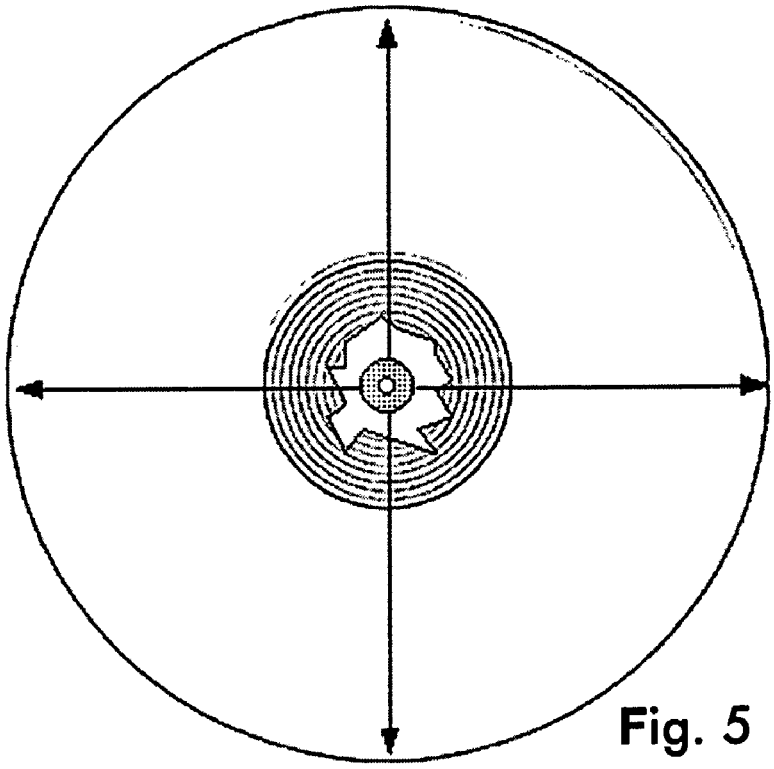
FIG. 5 is a top view showing the positional sensing characteristics of the invention.

FIG. 5 shows how a center mounted transducer provides uniform positional sensing capabilities from the center of the transducer to the edges of the striking surface as the percussion transducer is located equidistant from every edge of a round striking surface. This allows the striking surface to maintain its balance and rotate freely without changing the positional sensing characteristics.

Figure 6:
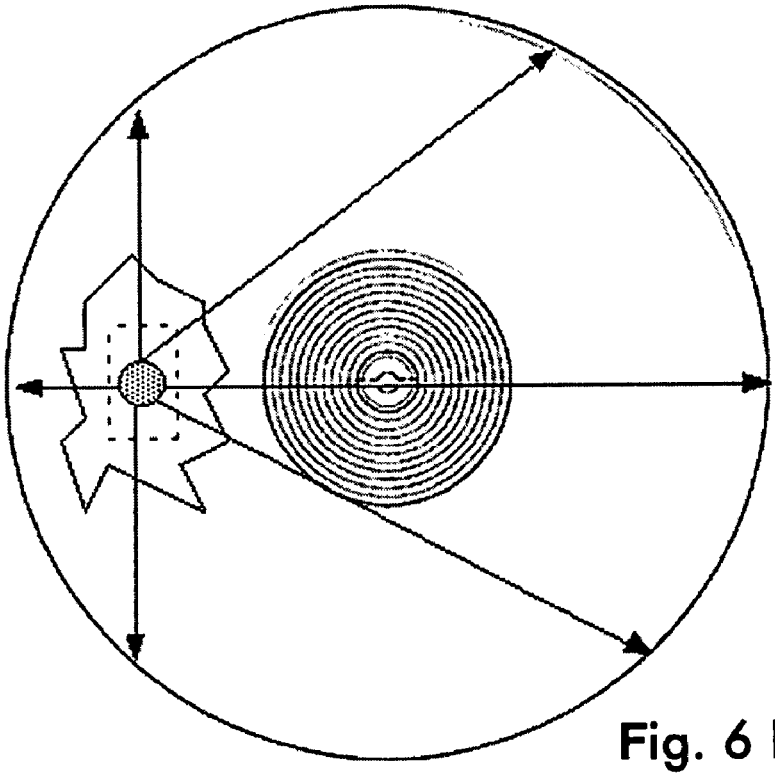
Fig. 6 Prior Art
FIG. 6 is a top view showing the positional sensing characteristics of the prior art.

For comparison, see FIG. 6, which shows a prior art flat transducer mounted on the underside of the striking surface at a point which is not centrally located, thus creating different distances to points on the edge of the round striking surface and making the striking surface unbalanced, thus causing undesired rotation after repetitive strikes. Since the striking surface is no longer balanced, it will tip over towards the side containing the transducer when placed on a typical cymbal mounting device.

Figure 7:
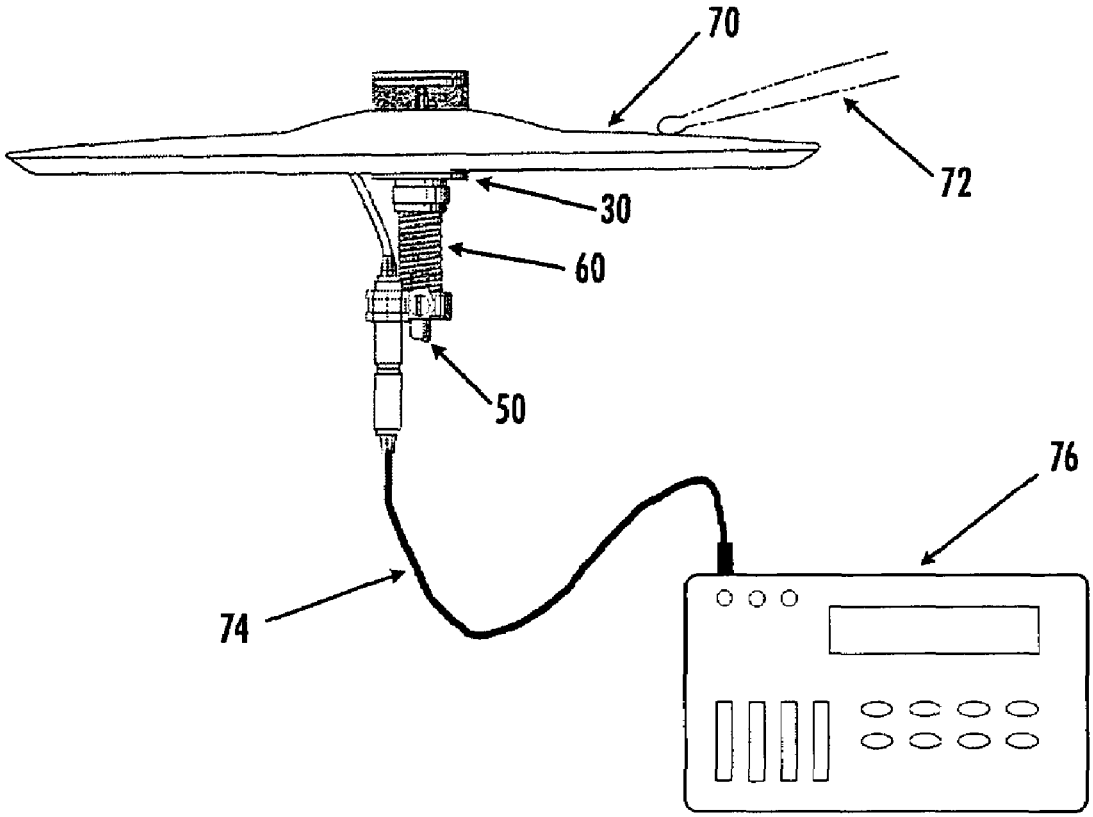
FIG. 7 is an overview showing how the percussion transducer is used.

FIG. 7 shows an example of how the percussion transducer might be utilized in the context of a cymbal trigger. The user strikes a cymbal surface (70) with a stick (72) causing it to vibrate. The percussion transducer (30) is mounted directly below the cymbal surface on the same axis and same cymbal mount spindle (50) with the spring mechanism (60). The percussion transducer converts the acoustic energy of the strike into an electrical trigger pulse signal which travels down a connecting wire (74) to a downstream electronic sound module (76). The downstream electronic sound module will analyze the trigger pulse signal and map it to a user selected sound, which in this case might be a cymbal sound.

The foregoing examples show how to make and use of the invention. While the preferred embodiment has been described, other embodiments might be useful in certain situations. Although the ring shape is generally superior, differently shaped piezo transducers could be used as long as they were centrally located to the striking surface.

Although the round striking surface is generally superior, any shaped striking surface may be used.

Although the striking surface material should exhibit a natural playability for the user (such as a real metal cymbal or a plastic or rubber electronic or practice cymbal), any striking surface could be used. For example, a punk rock musician might use a trash can lid as a striking surface.

Several alternative methods of adhesion could be utilized including epoxy, double sided tape, conductive tape or conductive epoxy, solder, or glue.

The washers could be made of any material which either is conductive or non-conductive. Conductive washers bonded to the piezo transducer with XYZ-Axis electrically conductive tape (such as 3M 9713 (TM) tape available from the 3M company) may provide more sensitivity. Alternatively, the protective washers may not even be utilized.

The wire leads may be attached directly to the top and bottom electrodes of the piezo transducer using solder or other conductive bonding methods.

Conductive shims may be used to connect the piezo electrodes to the wire leads, thus providing an entirely flat connection surface.

More than one piezo transducer may be stacked together to provide increased sensitivity.

The percussion transducer may be mounted anywhere along the central axis of the striking surface or along its mounting spindle, however acoustically coupling the piezo to the striking surface provides maximum sensitivity while reducing sympathetic vibrations.

The percussion transducer may be mounted directly onto the striking surface

If the percussion transducer is mounted directly onto the striking surface, a pressure sensitive tape switch or Force Sensing Resistor ("FSR") membrane switch may be attached around the circumference of the striking surface providing a method to "choke" the initial sound triggered by the percussion transducer, thus mimicking the effect of choking a real cymbal. The "choke" effect is a function of the electronic interface's interpretation of the transducer's electronic pulse signal and the state of the switch.

While a specific embodiment of the invention has been shown and described in detail to illustrate the application of the principles of the invention, it will be understood that the invention may be embodied otherwise without departing from such principles and that various modifications, alternate constructions, and equivalents will occur to those skilled in the art given the benefit of this disclosure. Thus, the invention is not limited to the specific embodiment described herein, but is defined by the appended claims.

What is claimed is:

1. A percussion transducer mounted on a cymbal having a striking surface and a center axis, comprising:

a round piezo ceramic element having a first surface and a second surface, and hole in its center so as to form an outside diameter and inside diameter;

a first lead wire attached to the first surface of the piezo ceramic element;

a second lead wire attached to the second surface of the piezo ceramic element;

and means for mounting said percussion transducer on the center axis of the cymbal;

a protective, ring shaped, first washer bonded to the first surface of said piezo ceramic element, a protective, ring shaped, second washer bonded to the second surface of said piezo ceramic element, and a protective coating substantially completely surrounding said piezo ceramic element to dampen high-frequency resonances.

2. A percussion transducer as set forth in claim 1 wherein the inside diameter is in a range on the order of 25% to 75% of the outside diameter.

3. A percussion transducer as set forth in claim 1 wherein said adhesive means comprises a silicone RTV adhesive.

4. A percussion transducer as set forth in claim 1 further comprising an electrode comprising a layer of silver material bonded to each of the first and second surfaces of the piezo element.

5. A percussion transducer as set forth in claim 1 wherein the piezo electric material is comprised of lead zirconate titanate (PZT).

6. A percussion transducer as set forth in claim 1, further comprising an electronic interface, coupled to said first lead wire and said second lead wire, suitable for generating sounds in response to electrical signals created by said piezo ceramic element in response to a user striking the cymbal.

7. A cymbal comprising:

a striking surface and a central axis perpendicular to said striking surface; and a percussion transducer as set forth in claim 1 mounted to said center axis.

8. A cymbal as in claim 7 wherein said percussion transducer is located above or below the central point of the striking surface along the center axis normal to the striking surface.

* * * * *